United States Patent [19]

Herrick

[11] Patent Number: 4,989,867

[45] Date of Patent: Feb. 5, 1991

[54] DAMPED TENNIS PRACTICE DEVICE

[76] Inventor: Robert M. Herrick, P.O. Box 5304, Arlington, Va. 22205

[21] Appl. No.: 348,604

[22] Filed: May 18, 1989

[51] Int. Cl.[5] ..... A63B 69/00

[52] U.S. Cl. ..... 273/29 A; 273/26 R; 273/184 B; 273/185 D

[58] Field of Search ..... 273/26 R, 26 E, 29 A, 273/184 B, 185 D, 58 C

[56] References Cited

U.S. PATENT DOCUMENTS

| | | | |
|---|---|---|---|
| 25,611 | 12/1935 | Andrew . | |
| 1,826,221 | 10/1931 | Pearson . | |
| 2,578,313 | 12/1951 | Moseley . | |
| 2,713,487 | 7/1955 | Jaediker . | |
| 3,051,491 | 8/1962 | Cabot . | |
| 3,147,979 | 9/1964 | Wolfe . | |
| 3,731,925 | 5/1973 | Caldwell | 273/58 C |
| 3,794,320 | 2/1974 | Salmont | 273/26 E |
| 3,924,853 | 12/1975 | Schleeger . | |
| 4,089,521 | 5/1978 | Berst et al. | 273/29 A |
| 4,105,203 | 8/1978 | Cho | 273/29 A |
| 4,204,678 | 5/1980 | Weis | 273/29 A |
| 4,307,888 | 12/1981 | Ohle . | |
| 4,417,730 | 11/1983 | Weiner . | |
| 4,508,340 | 3/1985 | Liao | 273/26 E |
| 4,531,734 | 7/1985 | Herrick . | |

*Primary Examiner*—Theatrice Brown

*Attorney, Agent, or Firm*—Hovey, Williams, Timmons & Collins

[57] ABSTRACT

A transportable, damped tennis practice device (10) is provided for the solitary practice of tennis strokes every two to three seconds. The device (10 )preferably includes a base (12), a ball (16), wand structure (14) for mounting the ball (16) on one end thereof, connecting assembly (18) for attaching the other end of wand structure (14) to the base (12). The wand structure (14) is flexibly, resiliently formed in a predetermined, arcuate shape. The device (10) stands in a ready position until ball (16) is struck by a practitioner at which time the ball (16) and wand structure (14) begin to oscillate pivotally on the base (12), while the wand structure (14) also flexes to shapes other than the predetermined shape. The damping apparatus (20) includes a rod-like member (114) which indirectly acts on the connecting assembly (18) to damp the oscillatory motion. In an alternative embodiment, the elevation of ball (16) is effectively raised by insertion of extension rod (120) between arm (90) and connection block (98).

7 Claims, 4 Drawing Sheets

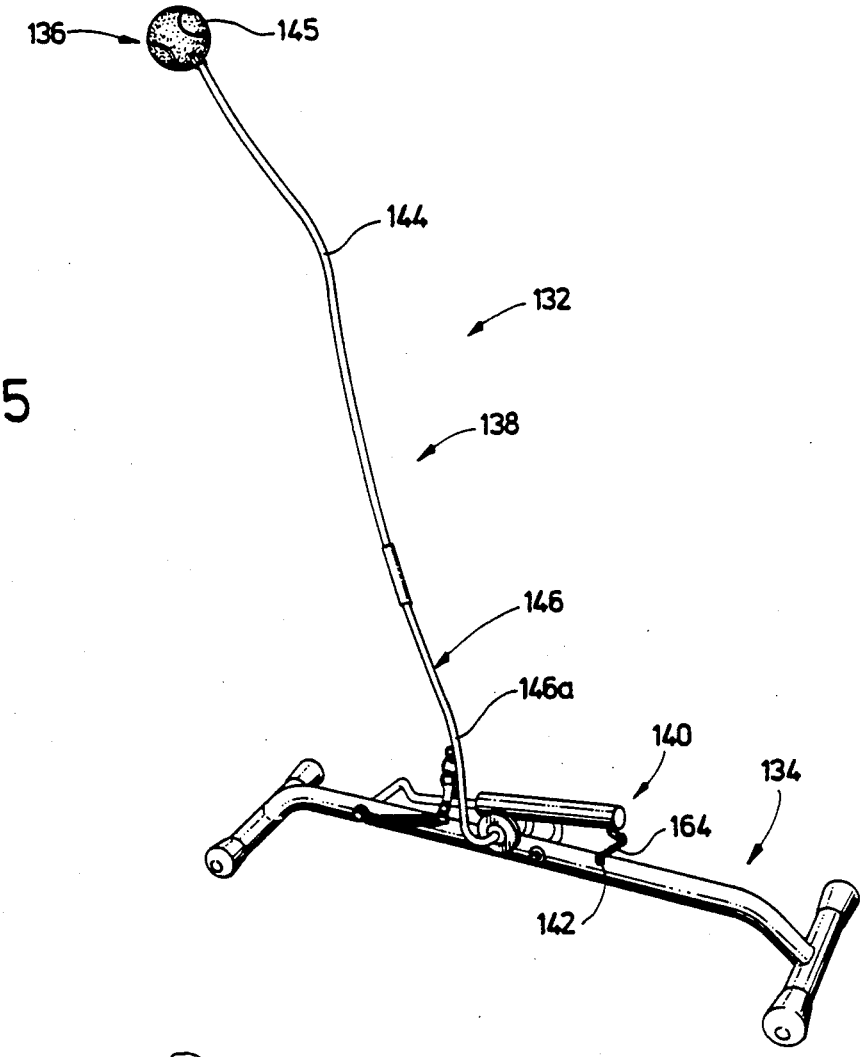
FIG. 5
FIG. 6
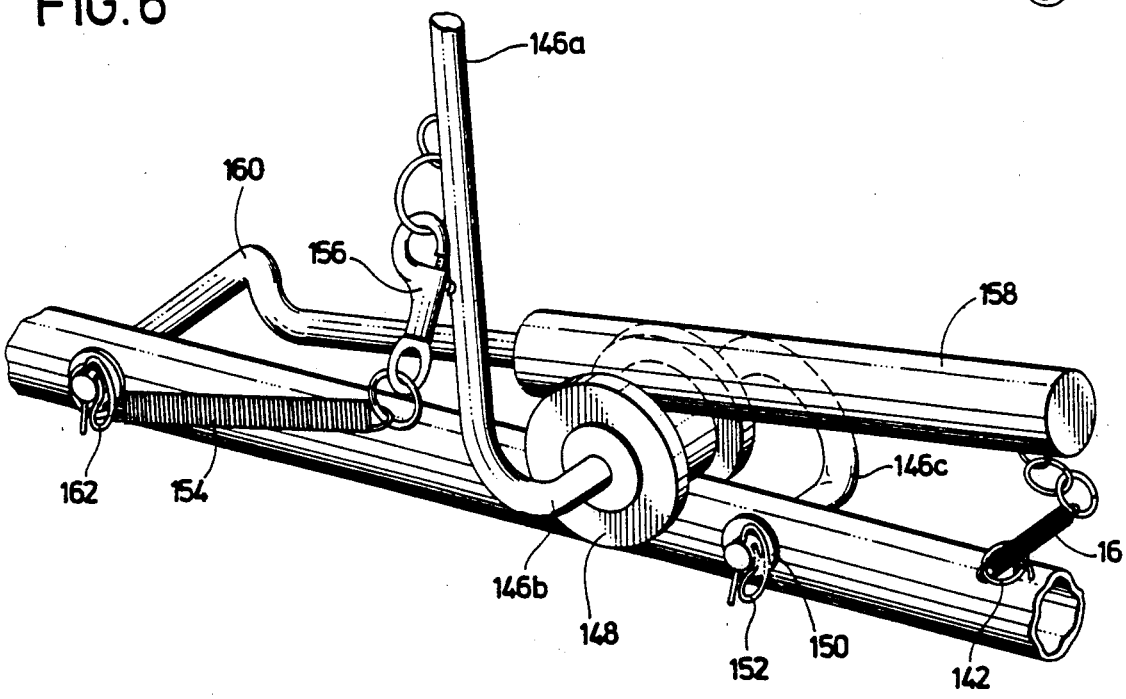

DAMPED TENNIS PRACTICE DEVICE

BACKGROUND OF THE INVENTION

1. Field of the Invention

This invention relates to a tennis practice device, which advantageously damps the oscillatory movement of a tennis ball after it is struck so that such movement occurs within a minimal time before the ball is ready for additional striking. More particularly, it is concerned with a damped tennis practice device having a support, wand structure having a tennis ball mounted on one end thereof, means for connecting the remote end of the wand to the support for pivoting movement of the wand and ball from and to a stationary ready position when the ball is struck, and apparatus for damping the oscillation of the wand after the ball is struck.

2. Description of the Prior Art

Many tennis players wish to practice by themselves, and accordingly many devices have been used in the past for this purpose. Besides conventional return walls found in the vicinity of tennis courts, practice devices for the home or some other convenient location can also be used. These devices typically contain a support, an arm pivotally held on the support for holding a tennis ball, structure for connecting the arm to the support, and some means for damping the oscillatory motion of the arm and ball after the ball is struck. Usually the damping arrangment employs one or more coil springs connected to the arm.

Generally the ball-holding arm is biased toward one particular orientation so that it may be struck repeatedly from one standing position.

The problem with the prior art in this field is that the ball and arm are not generally brought back to the ready position quickly enough. The reason for this problem is most easily seen by dividing the motion of the arm into two phases: (1) an oscillatory phase; and (2) a refractory phase. The oscillatory phase is characterized by one or more pivotal oscillations of the arm about the support, with the biasing, damping and impact forces determining the nature of such motion. The refractory phase begins when the oscillatory motion of the arm has substantially decayed. The refractory motion is characterized by vestigial oscillatory motion of the arm as well as the internal jostlings, rebounds and friction of the arm, ball and support.

The reason that spring damped structures do not adequately solve the problem of returning the arm and ball to a ready static position in a desirable period of time, is because the damping is of a variable nature due to Hooke's law. In other words, the damping force of a spring is proportional to the displacement of the arm from the equilibrium position of the spring. Generally then, as the oscillatory motion decreases, the damping force also decreases. Further compounding this difficulty is the fact that during the refractory period, the arm is relatively close to the equilibrium position of the spring (i.e., the ready position) and consequently there is little or no damping force exerted on the arm or the ball. Hence, motion during the 0 refractory period is only slightly damped if at all.

Patents illustrating these prior devices include U.S. Pat. Nos. 1,826,221, 2,578,313, 2,713,487, 3,051,491, 3,147,979, 3,924,853, 4,089,521, 4,307,888, 4,417,730, 4,531,734, and Australian Patent No. 25,611.

SUMMARY OF THE INVENTION

The problems outlined above are in large measure solved by the practice device of the present invention, which includes unique gravitational damping structure serving to rapidly (i.e., within about 5 seconds and preferably about 2–3 seconds) damp the oscillatory motion of the ball and support therefor. In addition, the device of the invention includes a ball-supporting elongated wand comprising a sectionalized, tubular body having a flexible, resilient, shape-retaining spine element therein, which further facilitates the rapid and uniform return movement of the ball to its static ready position. Finally, the device has a novel ball-connecting arrangement including a section of rope within the hollow tennis ball which absorbs impact forces and gives the ball the proper "feel" of actual tennis play.

Broadly speaking, the preferred practice device of the invention includes a support, a tennis ball, and elongated wand means for supporting the ball adjacent one end thereof. Connecting means is also provided for pivotally securing the ball-supporting wand to the support for pivotal movement of the wand from a stationary ready position, along with associated wand return means (e.g., a coil spring) serving to assist in the return of the wand and ball to the ready position after the ball has been struck. In order to assure the most rapid return of the ball to its ready position, damping means is provided which is separate from the wand and serves to gravitationally inhibit oscillation of the wand after the ball is struck.

The gravitational damping apparatus is advantageously in the form of an elongated rod which effectively rests on the connecting structure for the wand at a point close to the pivot axis thereof, to thereby prevent undue oscillation.

The most preferred ball-supporting wand is in the form of a sectionalized, flexible, hollow body including a central, shape-retaining spring metal spine and an elongated coil spring disposed about the spine. This arrangement further assists in the rapid return movement of the ball to its ready position after being struck.

BRIEF DESCRIPTION OF THE DRAWING

FIG. 5 is a perspective view of yet another embodiment of a damped tennis practice device in accordance with the invention; and FIG. 6 is a fragmentary view illustrating the damping apparatus of the device of FIG. 5.

DESCRIPTION OF THE PREFERRED EMBODIMENT

Figure 1:
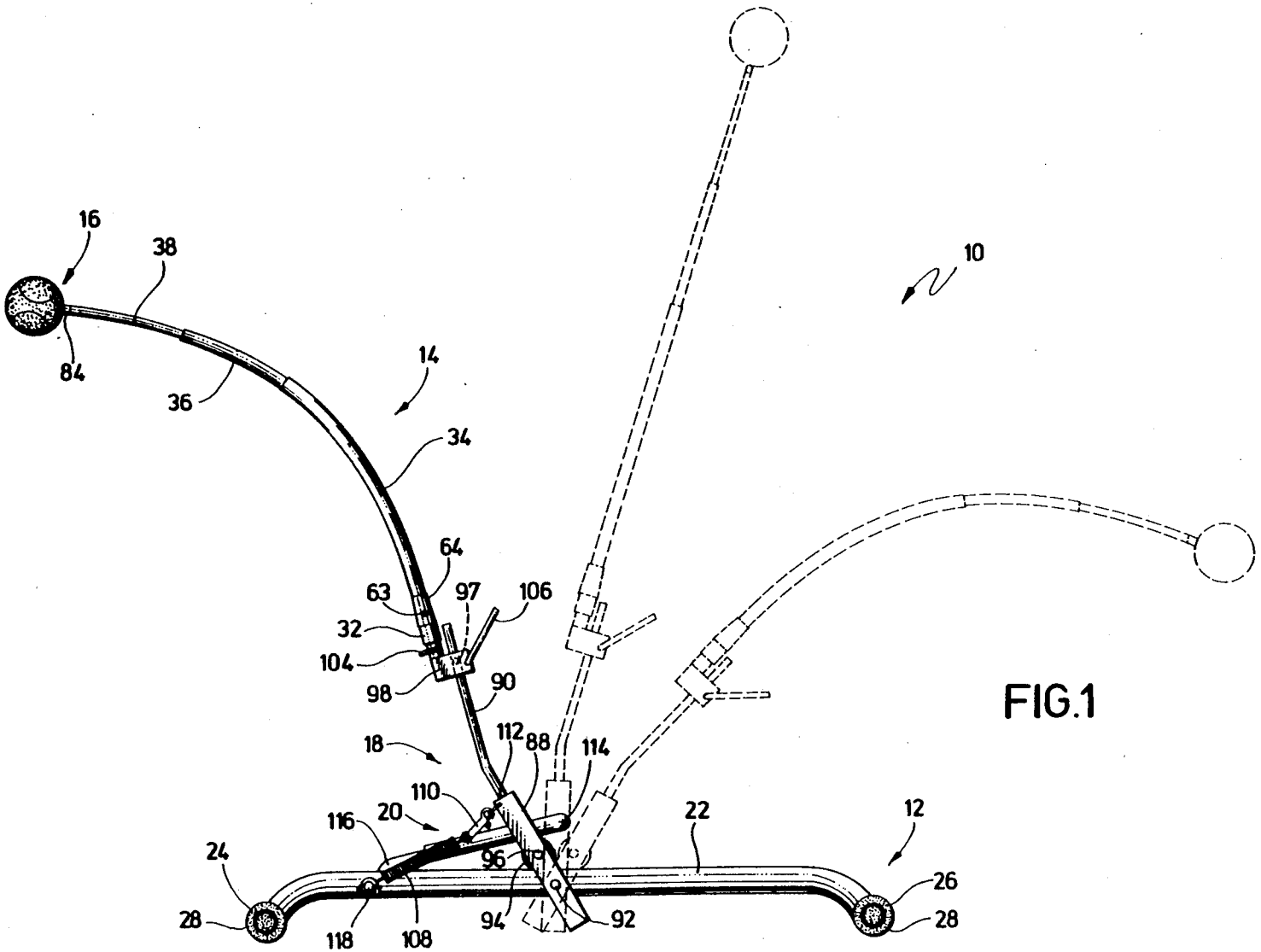
FIG. 1 is a side elevational view of a damped tennis practice device in the ready position thereof, with the apex position and maximum displacement of the device shown in phantom.
Figure 2:
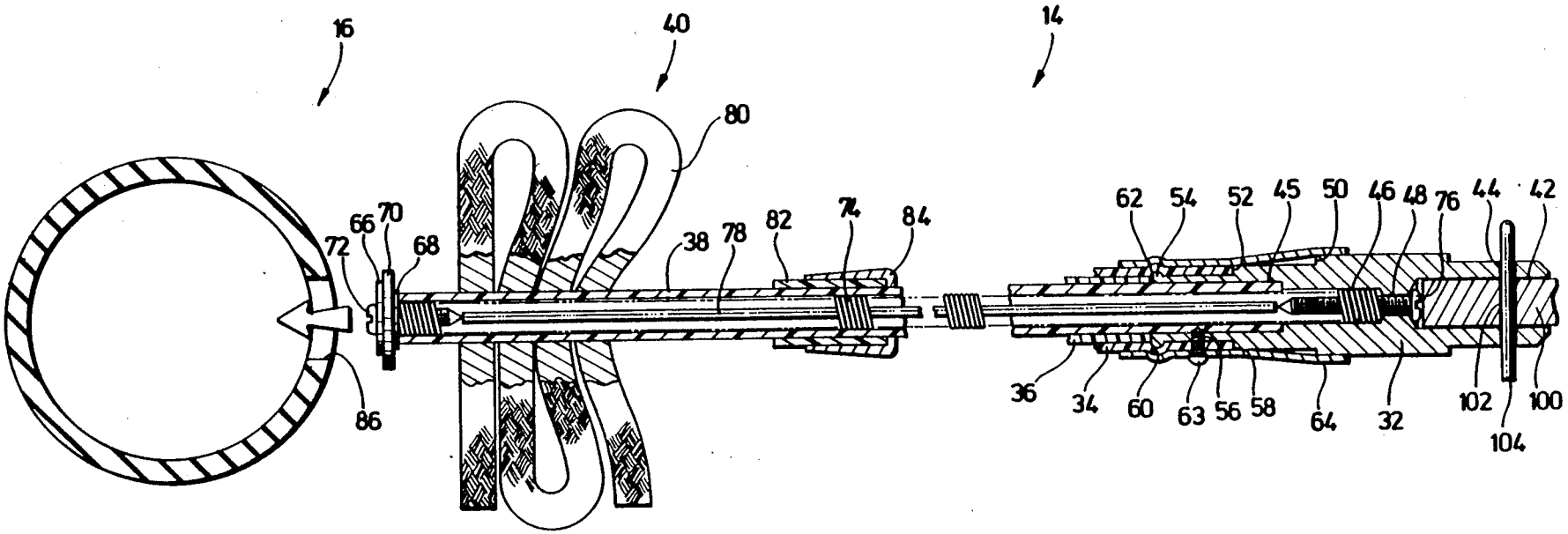
FIG. 2 is a fragmentary, partially cross-sectional view of the wand structure and ball of the tennis practice device.
Figures 3, 4:
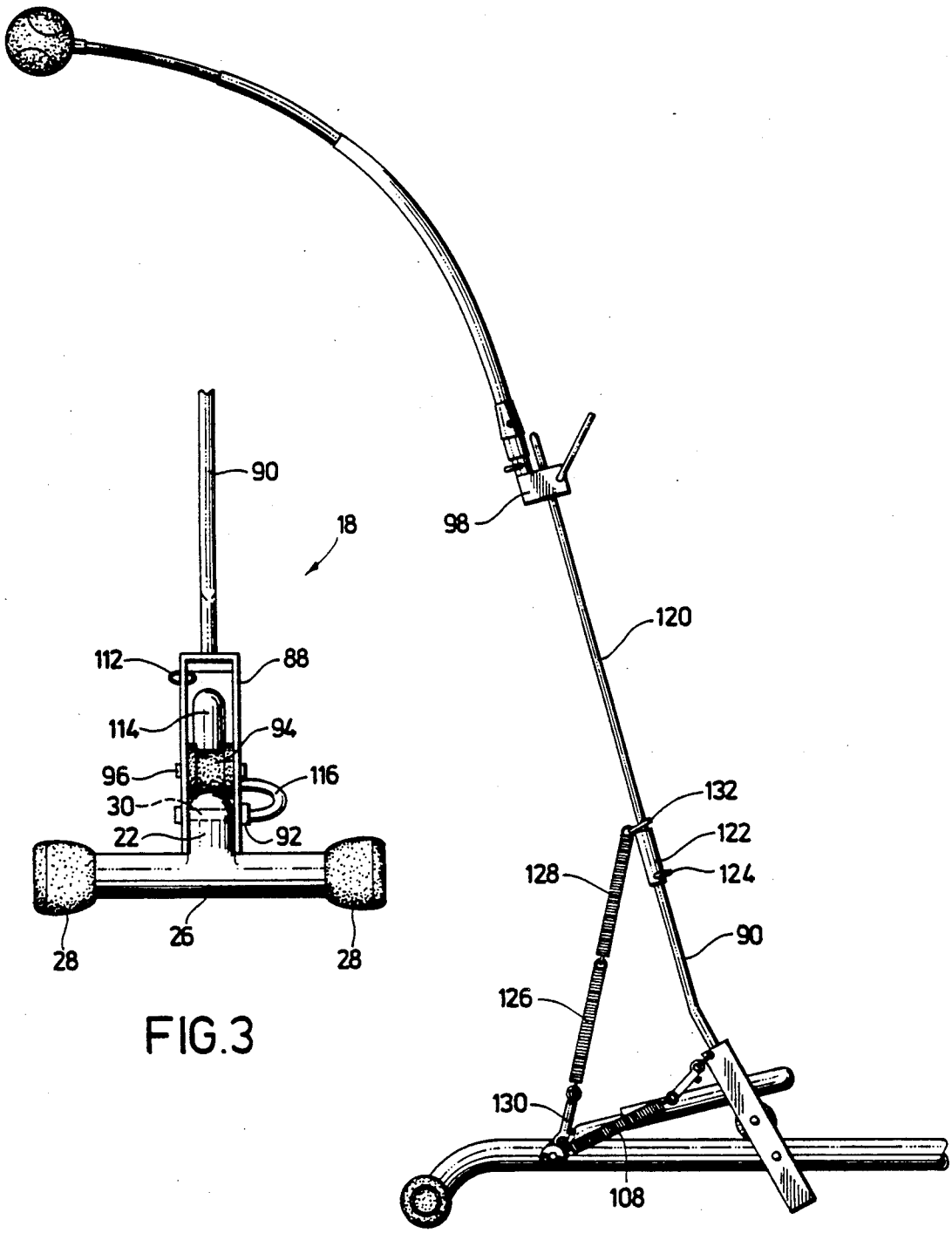
FIG. 3 is a fragmentary front view of the tennis practice device illustrating the details of the base and damping structure.
FIG. 4 is a side view of another embodiment of the present invention, depicting use of an extension for altering the height of the ball-supporting wand.

Turning now to the drawings, and particularly FIGS. 1–3, a tennis practice device 10 in accordance with the invention broadly includes a base 12, flexible wand structure 14 supporting a tennis ball 16, and a connection assembly broadly referred to by the numeral 18 for pivotally coupling wand structure 14 to base 12. A gravitational damping element 20 also forms a part of device 10 and is important for reasons to be described.

In more detail, base 12 includes an elongated, fore-and-aft extending central metallic tube 22 having a pair of laterally extending, ground-engaging feet 24,26 at respective ends thereof. The feet 24,26 include resilient end caps 28 as illustrated. Central tube 22 includes a pair of laterally spaced apertures therethrough including pivot aperture 30 (see FIG. 3).

Wand structure 14 is in the form of an elongated, arcuate arm and includes a lowermost, metallic base 32 together with three telescopically interfitted, synthetic resin tubes 34, 36 and 38 and a ball-connecting assembly 40 adjacent the upper end of tube 38.

As best seen in FIG. 2, base 32 is of stepped configuration and includes a lowermost connection bore 42, the defining sidewalls of which are apertured as at 44 for reasons to be made clear. An upwardly extending central bore 46, of smaller diameter than connection bore 44 and including a recess 45, is also provided, with the bores 42, 46 being in communication via tubular passageway 48. The outer defining surface of base 32 includes a pair of axially spaced-apart, annular steps or ledges 50,52, with an uppermost, radially expanded bead 54 defining the uppermost end of the base. The tubular portion of base 32 between ledge 52 and bead 54 includes three circumferentially spaced, tapped set screw bores 56, only one of which is visible in FIG. 2. Outermost tube 34 includes a circular butt end 58 and a circular dimple 60 adjacent the lower end thereof. This tube is secured to base 32 with the butt end 58 thereof in contact with ledge 52, and with dimple 60 in registry with bead 54.

Intermediate section 36 likewise includes a circular butt end 62 which contacts the uppermost face of bead 54. Finally, the longest, smallest diameter section 38 fits within recess 45 and contacts the inner surface of tubular section 36 as illustrated. As will be readily appreciated from a study of FIG. 2, the sections 34, 36 and 38 are secured to base 32 by means of set screws 63 which extend through appropriate apertures in the section 34, tapped bores 56, and locating bores provided in the sidewall of innermost section 38. Finally, a dimpled tubular cover 64, also secured by the screws 63, covers the connection between the sections 34–38 and base 32.

The uppermost end of section 38 is equipped with a terminating assembly in the form of a pair of metallic compression washers 66,68, a resilient bibb washer 70 sandwiched between the washers 66,68, and a pan screw 72. As illustrated, the terminating assembly is in covering relationship to the end of section 38, with the washer 68 in contact with the uppermost butt end of the section 38. An elongated coil spring 74 is disposed within and extends essentially the full length of section 38 (FIG. 2), and is secured in place by threaded attachment to upper pan screw 72; in like manner, the lower end of the spring 74 is secured by a threaded interconnection with pan screw 76, the latter extending through passageway 48 as illustrated. Finally, an elongated, shape-retaining, resilient spring metal spine 78 is located within coil spring 74 and in abutting contact with the pan screws 72,76. It will of course be appreciated that the upper terminating assembly of the section 38 is held in place by virtue of the threaded interconnection between screw 72 and the upper end of coil spring 74.

The ball-connecting assembly 40 includes a length of rope 80 which is affixed to the upper end of section 38 adjacent the washer 68. It will be seen that the rope 80 includes several loops, and that the rope is affixed to section 38 by passing the respective loops over the terminating assembly for the section 38. Specifically, the rope is generally flat and holes are burned therein, whereupon the rope sections are "buttoned" over the terminating assembly to secure the rope on to the section 38. In addition, the assembly 40 includes a shiftable sealing cap which is slidable on the section 38 and includes a short, circumscribing, synthetic resin bushing 82 together with an elongated, tapered, annular cover 84.

The ball 16 is a conventional tennis ball which has been cored (i.e., the stuffing removed) and provided with a mounting aperture 86 therethrough which is sized for the reception of ball-connecting assembly 40. In particular, the uppermost end of the section 38, together with the flexible rope 80, is inserted into the confines of ball 16 through aperture 86. At this point, the cover 84 and bushing 82 are slid upwardly into aperture 86 so as to complete the connection between section 38 and ball 16.

As best seen in FIG. 1, the wand structure 14 is an arcuate configuration. This is accomplished by prebending of the central spine 78 which causes the entire wand structure to assume the arcuate shape. Sections 34,38 are sufficiently flexible to assume such a shape without cracking or breaking.

Connection assembly 18 serves to operably couple base 12 and wand structure 14. To this end, the assembly 18 includes a lower, downwardly open, U-shaped connector 88 having an upwardly extending connection arm 90 secured to the upper bight thereof. The lower end of connector 88 is pivotally secured to central tube 22 by means of pin 92 extending through the arms of connector 88 and received within pivot aperture 30. The connector 88 also carries a resilient bushing 94 which is situated between the connector arms and is coupled in place by means of a transverse connector pin 96. It will be observed in this respect that, in the ready position of device 10 illustrated in bold lines in FIG. 1, bushing 94 rests atop tube 22.

The upper end of arm 90 is apertured as at 97 and is designed to receive a shiftable connector block 98. The latter includes a through aperture for slidably receiving the upper end of arm 90, together with a laterally spaced, upwardly projecting plug 100. Plug 100 (see FIG. 2) is sized to fit within connection bore 42 of base 32, and is provided with a through aperture 102 which registers with aperture 44. A pin 104 extends through the mated apertures 44,102 in order to interconnect plug 100 and wand structure 14.

The connector block 98 is further provided with a conventional, lever-operated friction lock which can be manipulated via operating lever 106 in order to secure block 98 at any one of a number of positions along the length of arm 90.

An elongated return spring 108 is operatively coupled between tube 22 and the upper end of connector 88. In order to facilitate breakdown of the device, a spring-type latch 110 is provided at the upper end of spring 108, for coupling to an appropriate ring 112 affixed to the upper end of connector 108. As will be readily appreciated, the spring 108 assists in return movement of the wand structure 14 during use of device 10.

Gravitational damping apparatus 20 includes an elongated rod-like member 114 which is designed to rest atop bushing 94 as illustrated in FIGS. 1 and 3. The end of member 114 remote from bushing 94 is connected to an arcuate pivot arm 116, which extends through tube 22 and is secured in place by means of pin 118; as illustrated, the lower end of spring 108 is connected to the extreme end of pivot arm 116 as well.

Another embodiment of the present invention is depicted in FIG. 4. In this form, an extension rod 120 is interposed between the arm 90 and connection block 98 of the embodiment described with reference to FIGS. 1–3. In particular, the extension rod 120 includes a lowermost, tubular, apertured connection cap 122 which is slipped over the extreme end of arm 90, with pin 124 being employed to interconnect the arm 90 and rod 120. The upper end of rod 120 functions exactly in the same manner as arm 90, i.e., it slidably receives connection block 98.

In this embodiment, a supplemental return spring, comprising spring segments 126,128, is connected between the base of spring 108 and extension rod 120. The lower connection of the supplemental spring is effected by means of a spring latch 130, whereas a ring 132, slipped over rod 120, secures the upper end of the supplemental spring.

The embodiment of FIG. 4 is identical in all respects with the first-described embodiment, save for the provision of extension rod 120 and its associated structure; accordingly a detailed description of the remainder of this embodiment is superfluous.

A third embodiment in the form of a device 132 is illustrated in FIGS. 5 and 6. The device 132 includes a base 134, ball 136, pivotal connection assembly 138, and gravitational damping apparatus 140.

Base 134 is identical with originally described base 12 except that a small spring connection ring 142 is affixed to the central tube thereof below the gravitational damping rod to be described.

Connection assembly 138 includes an upper, essentially rigid metallic wand 144, with tennis ball 145 supported on the upper end thereof. The connection between wand 144 and ball 145 can be effected by any desired means, for example that described relative to device 10. The lower end of wand 144 is operatively coupled to base 134 through a unitary pivot rod 146 which includes an upright portion **146*a*, a transversely extending portion 146*b* and an arcuate terminal portion 146*c* (see FIG. 6). A resilient spool-type bushing 148 (identical with bushing 94) is affixed to transverse portion 146*b* as illustrated, and in the rest position of device 132, rests on base 134. The arcuate portion 146*c* extends through an appropriate aperture in the central tube of base 134, and is secured in place by means of washer 150 and pin 152**.

A return spring 154, again identical with spring 108 of the first-described embodiment, is operatively connected between base 134 and upright portion **146*a*. Again, a spring latch 156 is employed for connection of the upper end of spring 154 and portion 146*a***.

The apparatus 140 includes damping element 158 designed to rest atop bushing 148, and which is coupled to base 154 through pivot arm 160. The latter is coupled to the central tube of the base by means of pin 162 (see FIG. 6). Finally, a secondary return spring 164 is coupled between the underside of element 158 and ring 142.

OPERATION

In operation, a practitioner uses a tennis racquet (not shown) to strike ball 16 causing it, wand structure 14 and connecting assembly 18 to oscillate as depicted in phantom in FIG. 1. Such oscillatory motion is advantageously damped as will be described below. The tennis practice device 10, shown in the stationary, ready position in the full line drawing of FIG. 1, is predisposed to assume such position in part by virtue of the action of retaining spring 108 acting on connector 88. Device 10 is also predisposed to assume the ready position by virtue of the predetermined shape of wand structure 14 which is due to the prebending of central spine 78 as described above. Spine 78 has shape "memory" due to the appropriate selection of metal and the prebending process. Wand structure 14 therefore reassumes the predetermined shape as quickly as possible after the distortion experienced when ball 16 is struck, this period being no more than five seconds, and when spine 78 is optimally bent in terms of the damping effect of member 114, the oscillation of wand structure 14 and ball 16 is substantially completed within two seconds from the time ball 16 is originally struck. It should also be noted that the predetermined arcuate shape effectively damps both the oscillatory and refractory motion. Therefore, ball 16 and wand structure 14 are capable of being essentially at rest in the ready position within two seconds of each striking.

When ball 16 is struck, ball 16, wand structure 14 and connector 88 begin exhibiting oscillatory motion. It will be appreciated that the wand structure 14 is not a rigid body and therefore when ball 16 is struck there is a relative straightening of wand structure 14; that is to say, the upper end of wand structure 14 accelerates more rapidly than the lower end. This phenomenon is readily explained when it is observed that the upper end has greater flexibility (due to the smaller diameter) and a longer moment arm about the pivot aperture 30 than does the lower end. Hence, once ball 16 has been struck the upper end of wand structure 14 accrues a relative angular velocity with respect to the lower end, that is to say, the upper end is moving faster in the direction of oscillatory movement than the lower end. This trend continues until ball 16 and wand structure 14 are pivotally displaced to a maximum displacement position (depicted in phantom as the far right position in FIG. (1). At this position there is no angular velocity for a brief instant and simultaneously the tension in retaining spring 108 is at its maximum with respect to all other positions in the oscillatory cycle.

Immediately the ball 16, wand structure 14, and connector 88 begin the return portion of the oscillatory motion. It will be appreciated that the entire cycle of such motion is gravitationally damped by member 114 acting on bushing 94. This gravitational damping is constant as opposed to the return action of retaining spring 108 which, of course, is dependent on Hooke's law (i.e., the force is proportional to the displacement from the equilibrium position).

Tube 22 is suspended slightly above ground, the ends thereof being arcuately-shaped so that in frictional cooperation with feet 24,26, the striking force of the racquet is directed substantially into the ground rather than laterally along the ground. The length of base 12 is about 28 inches so that it does not exceed the length of a conventional tennis bag. The reason for such a length is that the entire device 10 may therefore be transported in a conventional tennis bag. Such transport is accomplished by rotating lever 106 so as to release arm 90 and then separating ball 16, wand structure 14, and connector block 98 from connecting structure 18 and base 12. Hence, device 10 can be carried in two parts. Also for transportation purposes, the weight of the entire tennis device 10 is kept to the minimum necessary to perform its intended purposes. The optimum weight has been experimentally determined to be about 15 pounds.

The embodiment of FIG. 4 functions in essentially the same manner as FIG. 1 except that there is greater return tension due to spring segments 126,128. It will be also be appreciated that due to the elevation of ball 16 the device therefore accomodates different angles of shots as well as being more convenient for the volley strokes of a taller practitioner.

Referring to FIGS. 5 and 6, it will be readily appreciated that gravitational damping apparatus 140 of device 132 works in a very similar fashion to member 114 of device 10. The main difference is that damping element 158 of apparatus 140 acts directly on connecting assembly 138 (as opposed to the action of member 114 on connection pin 96 in the embodiments of FIGS. 1 and 4). Also, secondary return spring 164 act to secure damping element 158 in this embodiment. Otherwise, the embodiments of FIG. 1 and FIG. 5 function in strictly analogous fashion.

What is claimed is:

1. A damped tennis practice device comprising:

a support;

a ball;

wand means having a ball end and a support end, said wand means interconnecting said ball and said support;

means pivotally mounting said wand to said support;

resilient means interconnecting said support and said wand and oriented for biasing of said wand toward a stationary ready position during pivoting of said wand from the stationary ready position to a displaced position; and gravitationally operable damping means separate from said wand and ball including a weighted member pivotally mounted on said support and oriented for responsive pivoting relative to said wand such that said weighted member is upwardly displaced during pivoting of said wand from said ready position to said displaced position.

2. The damped tennis practice device of claim 1, wherein portions of said support form a plurality of feet adapted to rest on the ground and other portions thereof form an elongated base located slightly above said feet.

3. The damped tennis practice device of claim 1, wherein said support includes an elongated body presenting a longitudinal axis, and said weighted member includes an elongated damping rod in a common vertical plane with said longitudinal axis.

4. A damped tennis practice device as set forth in claim 1 wherein said support includes an elongated body presenting a longitudinal axis, said weighted member being pivotally moveable about an axis substantially transverse to said longitudinal axis.

5. A damped tennis practice device as set forth in claim 1 wherein said wand includes a plurality of telescopically interfitted resilient members, said wand being of greater flexibility adjacent said ball end than said support end.

6. A damped tennis practice device as set forth in claim 1 including a bushing member connected to said wand for responsive pivoting therewith and positioned for engagement with said weighted member during pivoting of said wand.

7. A damped tennis practice device as set forth in claim 1, said means for pivotally mounting said wand to said support including connection means, said connection means including extension means for effectively raising the elevation of said ball in said ready position.

* * * * *